US006714177B1

(12) United States Patent
Ishizuka

(10) Patent No.: US 6,714,177 B1
(45) Date of Patent: Mar. 30, 2004

(54) LIGHT-EMITTING DISPLAY DEVICE AND DRIVING METHOD THEREFOR

(75) Inventor: Shinichi Ishizuka, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/377,405

(22) Filed: Aug. 20, 1999

(30) Foreign Application Priority Data

Aug. 21, 1998 (JP) ..... 10-235809

(51) Int. Cl.[7] ..... G09G 3/30; G09G 3/32; G09G 3/10

(52) U.S. Cl. ..... 345/76; 345/82; 315/169.3

(58) Field of Search ..... 345/76, 77, 78, 345/79, 80, 82, 83; 315/169.3; 340/825.81

(56) References Cited

U.S. PATENT DOCUMENTS 5,719,589 A * 2/1998 Norman et al. ..... 345/82
5,828,181 A * 10/1998 Okuda ..... 315/169.3
5,844,368 A * 12/1998 Okuda et al. ..... 315/169.3
5,923,309 A * 7/1999 Ishizuka et al. ..... 345/82
6,195,076 B1 * 2/2001 Sakuragi et al. ..... 345/74
6,201,520 B1 * 3/2001 Iketsu et al. ..... 345/76
6,229,267 B1 * 5/2001 Ushigusa et al. ..... 315/169.4

* cited by examiner

*Primary Examiner*—Bipin Shalwala
*Assistant Examiner*—Jeff Piziali
(74) *Attorney, Agent, or Firm*—Sughrue Mion, PLLC

(57) ABSTRACT

A light-emitting display device with low power consumption and its driving method. In the driving method of a light-emitting display wherein light-emitting elements are connected to the intersections of positive electrode lines and negative electrode lines arranged in a matrix, either one of the positive electrode lines or the negative electrode lines are employed as scan lines with the other employed as drive lines; while scanning the scan lines, drive sources are connected to desired drive lines in synchronization with the scan, whereby allowing the light-emitting elements connected to the intersections of the scan lines and drive lines to emit light, a first reset voltage is applied to all of the scan lines and a second reset voltage that is greater than the first reset voltage is applied to all of the drive lines during a reset period after a scan period for scanning an arbitrary scan line is completed and before scanning the following scan line is started.

40 Claims, 17 Drawing Sheets

LIGHT-EMITTING DISPLAY DEVICE AND DRIVING METHOD THEREFOR

BACKGROUND OF THE INVENTION

1. Field of the Invention

The present invention relates to a light-emitting display device that employs light-emitting elements such as organic EL (electroluminescent) elements and a driving method therefor.

2. Description of Related Art

In recent years, organic EL elements that are self-light-emitting elements employing organic compounds have been extensively studied, and dot matrix displays employing an organic EL element have been developed as well.

FIG. 1 shows an equivalent circuit of an organic EL element. FIG. 2A shows the current luminance properties of the organic EL element, FIG. 2B shows the voltage-current properties of the organic EL element, and FIG. 2C shows the voltage luminance properties.

As shown in FIG. 1, the organic EL element can be represented by a light-emitting element E having diode properties, and the parasitic capacitance C connected in parallel to the light-emitting element E and the resistance R connected in series with the light-emitting element E.

As shown in FIGS. 2A through 2C, the organic EL element emits light with luminance in proportion to current. In the case where the driving voltage is less than the predetermined light emission specifying voltage Vth, it allows current to hardly flow, resulting in practically no emission.

FIG. 3 shows a driving method of a prior art light-emitting element.

The driving method shown in FIG. 3 is called the passive matrix driving method, in which the positive electrode lines A1 through A4 and the negative electrode lines B1 through Bn (n is a natural number. Four positive electrode lines are used for ease of explanation) are arranged in a matrix (grid). To each intersection of the positive electrode lines and the negative electrode lines arranged in a matrix, light-emitting elements E11 through E4*n* are connected. Either one of the positive electrode lines or the negative electrode lines are selected for scanning at constant intervals of time and other lines are driven by the constant-current sources 21 through 24, whereby light-emitting elements at arbitrary intersections are allowed for emitting light in synchronization with the scanning.

A voltage source may be used for the driving source, however, a current source may be preferably used to provide better reproducibility of luminance. This is because current luminance properties are more stable against changes in environmental temperature than voltage luminance properties, and current luminance properties of light-emitting elements have a linear proportionality.

In the case of FIG. 3, the driving source employs constant-current sources with the amount of constant current sufficient for the desired instantaneous luminance. Therefore, when the instantaneous luminance of light-emitting elements is desired to be equal to Lx, as shown in FIGS. 2A through 2C, the amount of constant current of a driving source is to be set to Ix. Also the voltage across both ends of the light-emitting element (hereinafter designated the light emission specifying voltage) becomes $V_x$ when light is emitted with desired instantaneous luminance (hereinafter designated a steady state of light emission).

There are two driving methods by means of said driving sources, namely, scanning negative electrode lines and driving positive electrode lines, and scanning positive electrode lines and driving negative electrode lines. FIG. 3 shows the method of scanning negative electrode lines and driving positive electrode lines. The negative electrode line scan circuit, 1, is connected to the negative electrode lines B1 through Bn. The positive electrode line drive circuit 2 that comprises the current sources 21 through 24 and the drive switches 31 through 34 are also connected to the positive electrode lines A3 through A4.

The negative electrode line scan circuit 1 performs scanning while sequentially switching the scan switches 11 through 1*n* over to the ground terminal sides at constant intervals of time, thereby providing negative electrode lines B1 through Bn with ground potential (0V) in sequence. Furthermore, the positive electrode line drive circuit 2 controls the on and off of the drive switches 31 through 34 in synchronization with the switch scanning of said negative electrode line scan circuit 1. This allows the positive electrode lines A1 through A4 to be connected with the constant-current sources 21 through 24 to supply driving current to light-emitting elements located at desired intersections. These negative electrode line scan circuit 1 and the positive electrode line drive circuit 2 are drive-controlled by means of a control circuit that is not shown.

For example, a case where the light-emitting elements E11 and E21 are lit is taken as an example. As shown in the drawing, when the scan switch 11 of the negative electrode line scan circuit 1 is switched to the ground side with the ground potential applied to the first negative electrode line B1, the drive switches 31 and 32 of the positive electrode line drive circuit 2 are preferably switched over to the sides of the constant-current sources to connect the constant-current sources 21 and 22 to the positive electrode lines A1 and A2. By repeating the scanning and driving at a high speed, control is performed in a manner such that light-emitting elements at arbitrary positions are lit as if each light-emitting element emits light at the same time.

Other negative electrode lines B2 through Bn except for negative electrode line B1 that is being scanned are connected with the constant voltage sources 42 through 4*n* to apply a reverse bias voltage V1 that has the same potential as the light emission specifying voltage $V_x$. This prevents the light-emitting elements E12 through E1*n* and E22 through E2*n*, connected to the positive electrode lines A1 and A2, emitting light accidentally.

The reverse bias voltage sources 41 through 4*n*, which provide the reverse bias voltage V1, are provided so that light-emitting elements connected to the intersections of the positive electrode lines A1 and A2 to be driven and the negative electrode lines B2 through Bn not to be scanned (E12 through E1*n* and E22 through E2*n* in the case of FIG. 3) do not emit light accidentally. Accordingly, the voltage applied thereto is preferably set in a manner such that the voltage across both ends of the light-emitting element is equal to or less than the light emission threshold voltage Vth. However, the reverse bias voltage V1 is best set to the light emission specifying voltage $V_x$ for the reason mentioned below. That is, letting $V1=V_x$ causes the voltage across both ends of the light-emitting element to become 0, and thus the current supplied by the drive source flows only into the light-emitting elements that are emitting light, thereby reproducing a desired luminance in accuracy.

As mentioned above referring to FIG. 3, the state of charge of each parasitic capacitance of each light-emitting element is as follows. The light-emitting elements E11 and E21 connected to the intersections of the positive electrode lines A1 and A2 to be driven and the negative electrode line B1 to be scanned are forward charged. The light-emitting elements E11 through E1*n* and E22 through E2*n* connected to the intersections of the positive electrode lines A1 and A2 to be driven and the negative electrode lines B2, B3, and B4, which are not scanned, are not charged. The light-emitting elements E31 and E41 connected to the intersections of the positive electrode lines A3 and A4 not to be driven and the negative electrode line B1 to be scanned are not charged. The light-emitting elements E32 through E3*n* and E42 through E4*n*, connected to the intersections of the positive electrode lines A3 and A4, which are not driven, and the negative electrode lines B2, B3, and B4, which are not scanned, are reverse charged. (In the drawing, each light-emitting element E is represented by the symbol of a capacitor, a light-emitting element that is lit is represented by the symbol of a diode, and a capacitor that is charged is shaded.)

This driving method, however, had the following problem caused by parasitic capacitance C in the equivalent circuit of a light-emitting element shown in FIG. 1. The problem will be explained below.

In FIGS. 7A and 7B, the light-emitting elements E11 through E1*n* connected to said positive electrode line A1 in FIG. 3 are extracted with each of the light-emitting elements E11 through E1*n* shown only by said parasitic capacitance C. In a case where the positive electrode line A1 is not driven at the time of scanning the negative electrode line B1, the parasitic capacitors C12 through C1*n* of the light-emitting elements E12 through E1*n* other than the parasitic capacitor C11 of the light-emitting element E11 connected to the negative electrode line B1 which is currently scanned, are charged by the reverse bias voltage V1 applied to each of the negative electrode lines B2 through Bn which are charged in the direction as shown in FIG. 7A.

When the scanning position is shifted from the negative electrode line B1 to the following negative electrode line B2, the positive electrode line A1 is driven to cause, for example, the light-emitting element E12 to emit light providing the circuit status as shown in FIG. 7B. At the instant circuits are switched over like this, not only is the parasitic capacitor of the light-emitting element E12 that is to be lit charged but also other parasitic capacitors of the light-emitting elements E13 through E1*n* connected to other negative electrode lines B3 through Bn are charged by letting current flow therein in the direction shown with the arrows.

As mentioned in the foregoing, a light-emitting element is not allowed to emit light with a desired luminance unless the voltage across both ends thereof reaches the light emission specifying voltage $V_x$. According to the prior art driving method, as shown in FIGS. 7A and 7B in the foregoing, when the positive electrode line A1 is driven to allow the light-emitting element E12 connected to the negative electrode line B2 to emit light, which causes not only the parasitic capacitor of the light-emitting element E12 that to be lit but also other light-emitting elements E13 through E1*n* that are connected to the positive electrode line A1 to be charged. Thus, until the parasitic capacitors of all these light-emitting elements have been completely charged, the voltage across both ends of the light-emitting element E12 connected to the negative electrode line B2 is not allowed to reach the light emission specifying voltage $V_x$.

Accordingly, in the prior art driving method, there was a problem in that the rate of rise was slow until light emission was fired and a high-speed scanning could not be performed.

Said problem would exert adverse effects with the increasing number of light-emitting elements. Especially, in the case of employing organic EL elements as light-emitting elements, the effect of said problem would be brought to the fore since organic EL elements have a large parasitic capacitance C due to the surface light emission scheme thereof.

A driving method for solving the aforementioned problem is disclosed in Japanese Patent Kokai No. Hei 9-232074.

The driving method disclosed in said publication will be explained referring to FIG. 3 through FIG. 6. FIG. 3 is a view for explaining the state of light emission A, FIG. 4 is a view for explaining the state of reset, FIG. 5 is view for explaining the transition to the state of light emission B, and FIG. 6 is a view for explaining the state of light emission B.

For explanation, taken as an example is the case of shifting from a state where the light-emitting elements E11 and E12 are lit at the time of scanning the negative electrode line B1, through the reset period shown in FIG. 4, and then to a state where the light-emitting elements E22 and E32 are lit at the time of scanning the negative electrode line B2 as shown in FIG. 5 and FIG. 6.

The point in said publication is that, in the case of allowing the light-emitting elements E22 and E32 to emit light following the light-emitting elements E11 and E21, a reset period is provided for resetting the voltages across both ends of all light-emitting elements E11 through E4*n* to 0 potential while scanning is switched from the negative electrode line B1 over to the negative electrode line B2 to allow charge accumulated in parasitic capacitors C to be discharged.

That is, as shown in FIG. 4, all scan switches 11 through 1*n* connected to the negative electrode lines are connected to the ground side, and all drive switches 31 through 34 connected to the positive electrode lines are connected to the ground side, and thus the charge accumulated in the parasitic capacitors of all light-emitting elements E11 through E4*n* are discharged.

Once all light-emitting elements have been completely reset, scanning is shifted to the negative electrode line B2 to address the light-emitting elements E22 and E32 as shown in FIG. 5.

That is, the negative electrode line B2 is connected to the ground potential, the negative electrode lines B1 and B3 through Bn are also connected with the reverse bias voltage sources 41 and 43 through 4*n*, the positive electrode lines A2 and A3 to which the light-emitting elements E22 and E32 are connected are connected to the constant-current sources 22 and 23, and the remaining positive electrode lines A1 and A4 are connected to the ground potential.

As mentioned above, at the instant the scan switches 11 through 1*n* and drive switches 31 through 34 are switched over, the potential of the positive electrode lines A2 and A3 becomes approximately equal to V1 (more precisely n−1/n·V1), and the voltage across both ends of the light-emitting elements E22 and E32 becomes a forward bias voltage approximately equal to the light emission specifying voltage $V_x$. Hence, the light-emitting elements E22 and E32 are quickly charged by the current from a plurality of routes shown with arrows in FIG. 5, and then are allowed to shift to a steady state of light emission shown in FIG. 6 instantaneously. In FIG. 6, the driving current supplied by the constant-current sources 22 and 23 flows only into the light-emitting elements E22 and E32 respectively, so that the light-emitting elements E22 and E32 are allowed to emit light with a desired instantaneous luminance Lx.

OBJECTS AND SUMMARY OF THE INVENTION

In the conventional driving method mentioned above, the problem relating to the rate in rise of light emission was eliminated. However, there still was a problem that power consumption increases since the charge accumulated in light-emitting elements is to be discharged completely each time scanning is shifted. Furthermore, the possibility of losing the display quality of images is developed due to the provision of the non-light emission period of a reset period at each time of scanning.

An object of the present invention is to provide a light-emitting display device with low power consumption and the driving method therefor. Another object is to improve display quality.

According to a first aspect of the present invention, in the driving method of a light-emitting display wherein light-emitting elements are connected to the intersections of positive electrode lines and negative electrode lines arranged in a matrix, either one of the positive electrode lines or the negative electrode lines are employed as scan lines with the other employed as drive lines; while scanning the scan lines, drive sources are connected to desired drive lines in synchronization with the scanning, whereby allowing the light-emitting elements connected to the intersections of the scan lines and drive lines to emit light, during a reset period after a scan period for scanning an arbitrary scan line is complete and before scanning the following scan line is started, a first reset voltage is applied to all of the scan lines and a second reset voltage that is greater than the first reset voltage is applied to all of the drive lines.

According to another aspect of the present invention, the difference between the second reset voltage and the first voltage is set to be lower than the light emission threshold voltage of the light-emitting element.

According to still another aspect of the present invention, the drive lines are connectable to either the drive source or a second reset voltage source for providing the second reset voltage, and the scan lines are connectable to either a first reset voltage source for providing the first reset voltage or a reverse bias voltage source for providing a predetermined reverse bias voltage.

According to still another aspect of the present invention, the first reset voltage source provides the ground potential.

According to still another aspect of the present invention, the reverse bias voltage source is almost the same as the voltage value determined by subtracting the second reset voltage from the light emission specifying voltage of a light-emitting element.

According to still another aspect of the present invention, during the reset period, all of the drive lines are connected to the second reset voltage source and all of the scan lines are connected to the first reset voltage source.

According to still another aspect of the present invention, during the scan period, scan lines to be scanned are connected to the first reset voltage source, scan lines not to be scanned are connected to the reverse bias voltage source, drive lines to be driven are connected to the drive sources, and drive lines not to be driven are connected to the second reset voltage source.

According to still another aspect of the present invention, the drive lines are connectable to either one of the drive sources, the second reset voltage source for providing the second reset voltage, or grounding means for providing the ground potential, the scan lines are connectable to either the first reset voltage source for providing the first reset voltage or the reverse bias voltage source for providing a predetermined reverse bias voltage.

According to still another aspect of the present invention, the first reset voltage source provides the ground potential.

According to still another aspect of the present invention, the reverse bias voltage source has almost the same voltage as the light emission specifying voltage of light-emitting elements.

According to still another aspect of the present invention, during the reset period, all of the drive lines are connected to the second reset voltage source and all of the scan lines are connected to the first reset voltage source.

According to still another aspect of the present invention, during the scan period, scan lines to be scanned are connected to the first reset voltage source, scan lines not to be scanned are connected to the reverse bias voltage source, drive lines to be driven are connected to the drive sources, and drive lines not to be driven are connected to the grounding means.

According to still another aspect of the present invention, the light-emitting elements are organic EL elements.

According to still another aspect of the present invention, the drive sources are constant-current sources.

According to still another aspect of the present invention, in a light-emitting display device in which light-emitting elements are connected to intersections of positive electrode lines and negative electrode lines arranged in a matrix, either one of the positive electrode lines or the negative electrode lines are employed as scan lines with the other employed as drive lines, a scan period during which drive sources are connected to desired drive lines while scanning the scan lines in synchronization with the scan and thus the light-emitting elements connected to the intersections of the scan lines and drive lines are lit, and a reset period for providing reset voltage for light-emitting elements are alternately repeated for display by light emission, the light-emitting display device comprises: scan switch means for enabling either of grounding means for providing a ground potential or a reverse bias voltage source for providing a predetermined reverse bias voltage to connect to each of the scan lines; drive switch means for enabling either of the drive source or reset voltage sources for providing the reset voltage to connect to each of the drive lines; and control means for controlling the switching of the scan switch means and the drive switch means in accordance with light emission data being inputted.

According to still another aspect of the present invention, the reset voltage is set to be lower than the light emission threshold voltage of the light-emitting elements.

According to still another aspect of the present invention, the reverse bias voltage source has almost the same voltage as the voltage determined by subtracting the reset voltage from the light emission specifying voltage of light-emitting elements.

According to still another aspect of the present invention, during the reset period, all of the scan switch means are connected to the grounding means and the drive switch means are connected to the reset voltage source.

According to still another aspect of the present invention, during the scan period, the scan switch means to be scanned are connected to the grounding means, the scan switch means not to be scanned are connected to the reverse bias voltage sources, the drive switch means to be driven are connected to the drive sources, and the drive switch means not to be driven are connected to the reset voltage sources.

According to still another aspect of the present invention, the drive switch means allow for selectively connecting to either one of the drive sources, the reset voltage sources, or grounding means for providing the ground potential.

According to still another aspect of the present invention, the voltage of the reverse bias voltage source is set to be almost the same as the light emission specifying voltage of the light-emitting elements.

According to still another aspect of the present invention, during the reset period, all of scan switch means are connected to the grounding means and the drive switch means are connected to the reset voltage sources.

According to still another aspect of the present invention, during the scan period, the scan switch means to be scanned are connected to the grounding means, the scan switch means not to be scanned are connected to the reverse bias voltage sources, the drive switch means to be driven are connected to the drive sources, and the drive switch means not to be driven are connected to the grounding means.

According to still another aspect of the present invention, the light-emitting elements are organic EL elements.

According to still another aspect of the present invention, the drive sources are constant-current sources.

DETAILED DESCRIPTION OF THE PREFERRED EMBODIMENTS

Referring to FIG. 8 through FIG. 11, an embodiment of the present invention will be explained. In the embodiment to be explained below, it is to be understood that light-emitting elements are to be emitted at the same instantaneous luminance $L_x$ as that of the prior art, and the constant current $I_x$ of a constant-current source and the light emission specifying voltage $V_x$ are to be set to the same value as that of the prior art.

Figure 8:
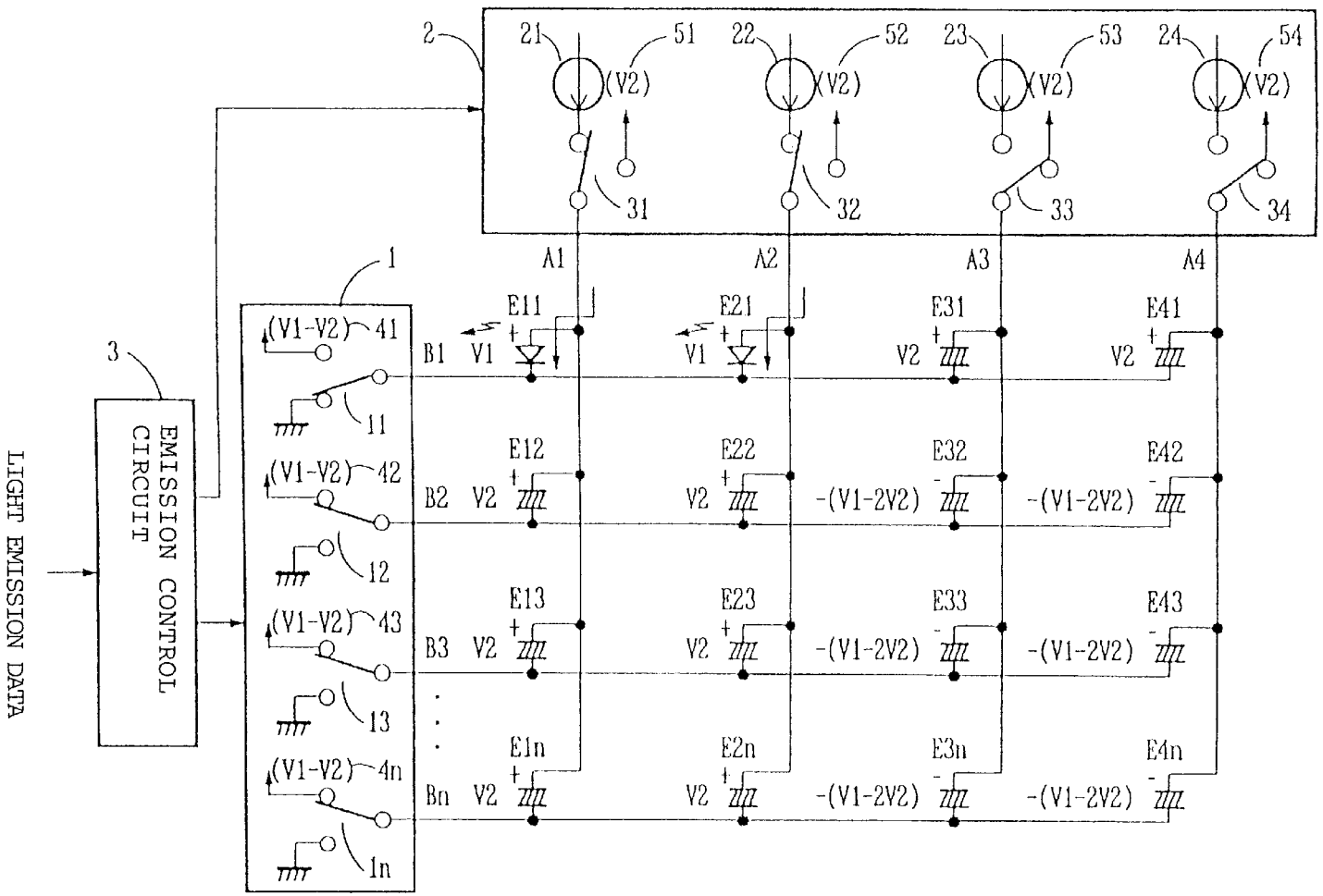
FIG. 8 is a view showing a configuration of the first embodiment of the present invention under light emission status A.
Figure 9:
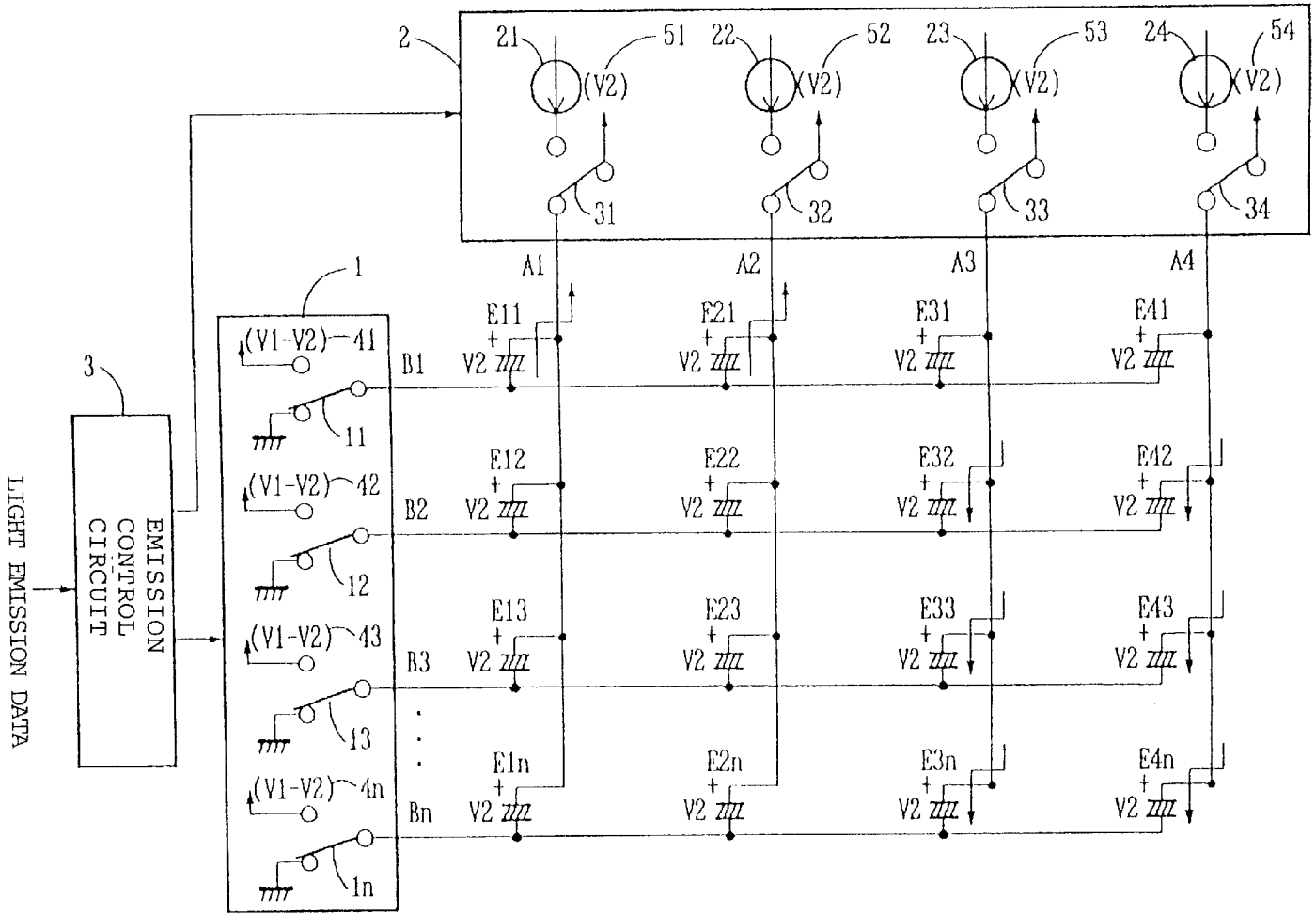
FIG. 9 is a view showing a configuration of the first embodiment of the present invention under reset status.
Figure 10:
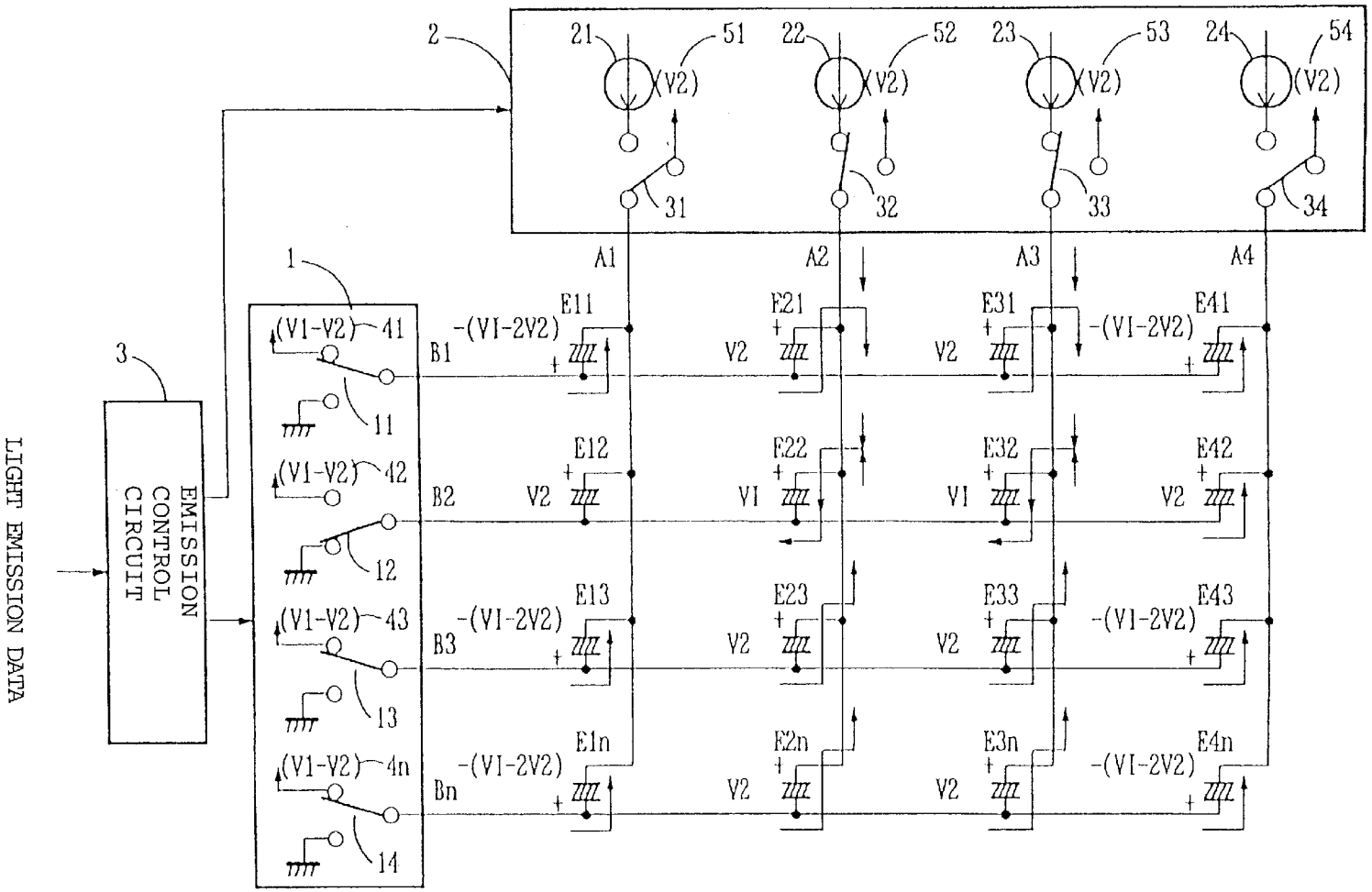
FIG. 10 is a view showing a configuration of the first embodiment of the present invention at the time of switchover to light emission status B.
Figure 11:
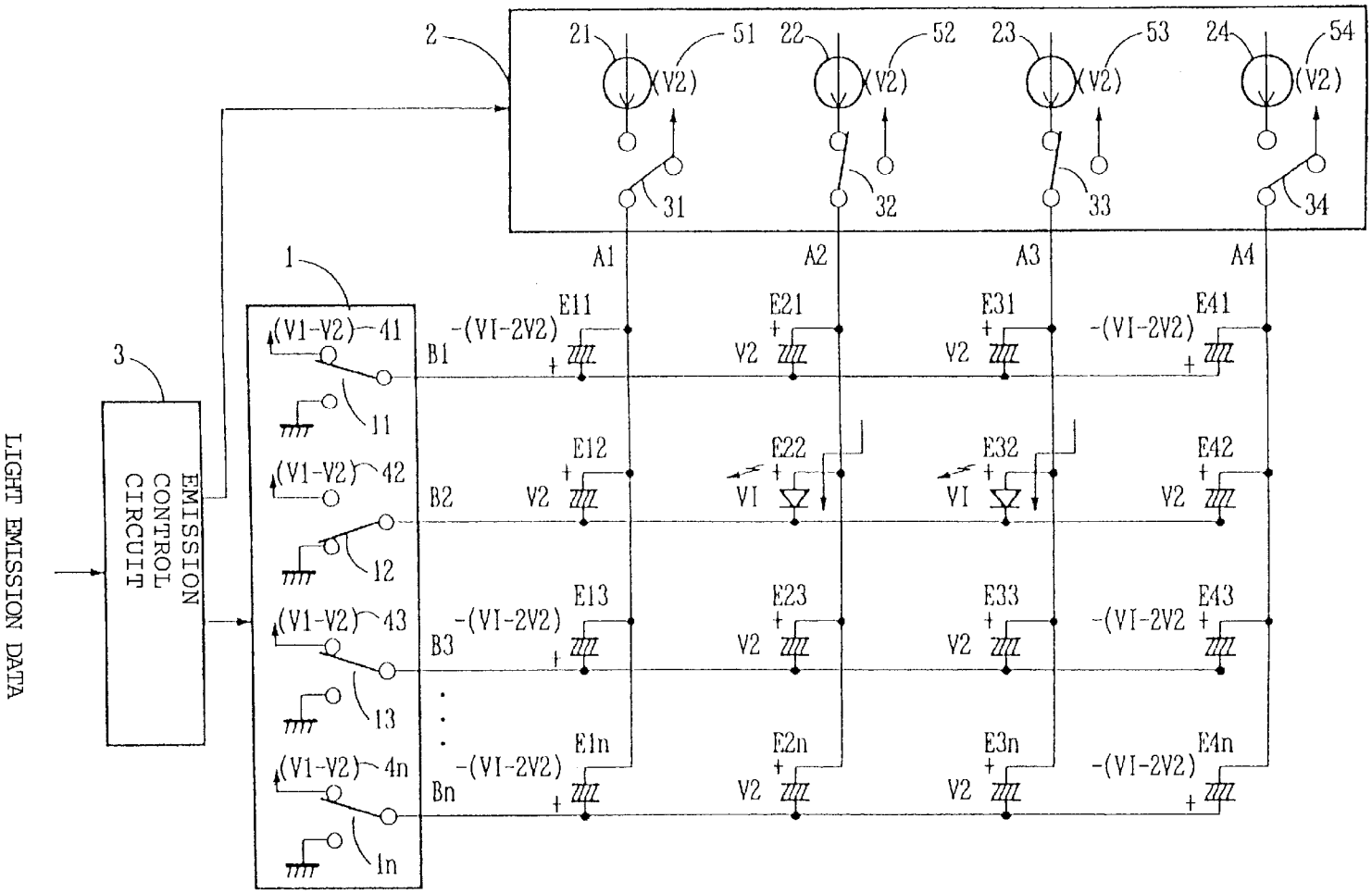
FIG. 11 is a view showing a configuration of the first embodiment of the present invention under light emission status B.

FIG. 8 through FIG. 11 are views showing the configuration of a first embodiment of the present invention, FIG. 8 shows the light emission status A, FIG. 9 shows the reset status, FIG. 10 shows the time of switchover to the light emission status B, and FIG. 11 shows the light emission status B.

Figure 17:
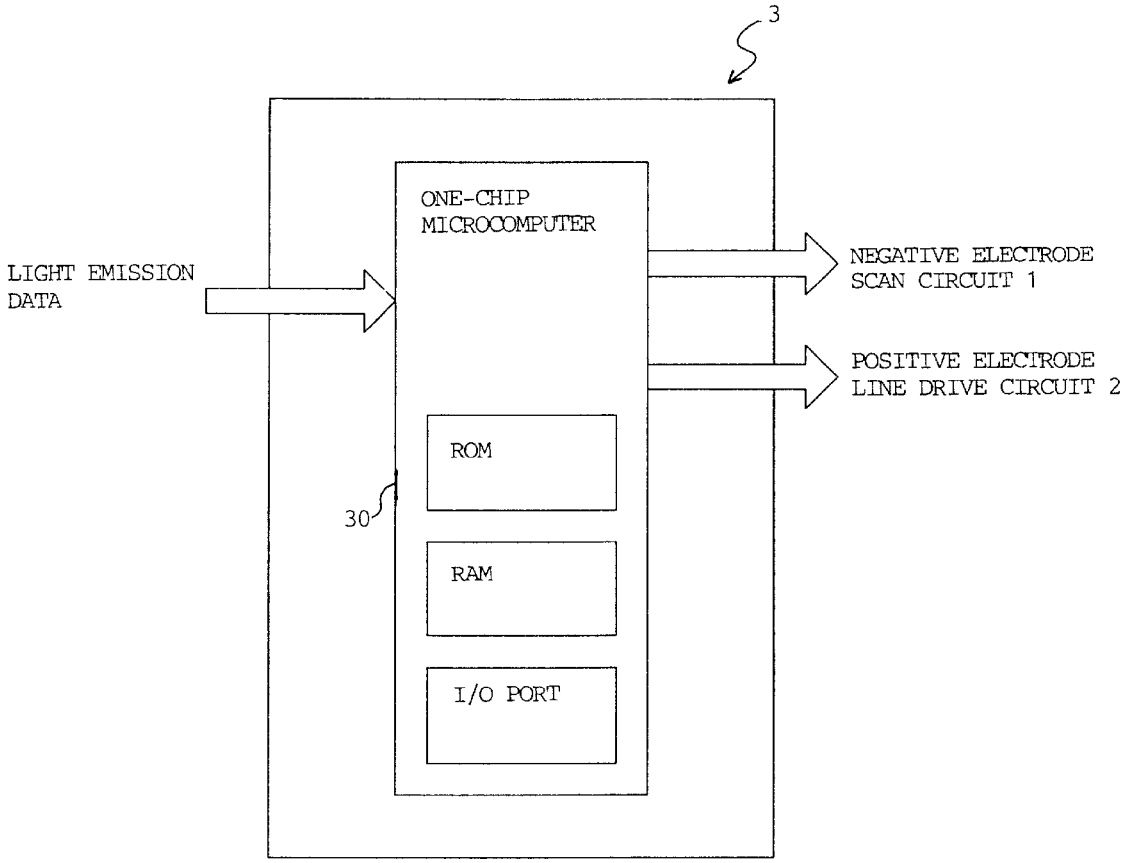
FIG. 17 is a diagram showing an example of the structure of the light emission control circuit 3.

Referring to FIG. 8 through FIG. 11, A1 through A4 are positive electrode lines (it is to be understood that there are more than four lines normally, however, there are provided only four lines for convenience of explanation), and B1 through Bn are negative electrode lines (n is a natural number). E11 through E4*n* are light-emitting elements, such as organic EL (electroluminescent) elements, connected to each intersection. 1 is the negative electrode line scan circuit, 2 is the positive electrode line drive circuit, and 3 is the light emission control circuit to which light emission data is supplied. The light emission control circuit 3 may be a control circuit of a known structure that provides driving signals of the negative electrode scan circuit 1 and the positive electrode line drive circuit 2. For instance, a one-chip microcomputer 30 having a ROM, a RAM, and an I/O port may be used in the light emission control circuit 3 as shown in FIG. 17. In such a case, the microcomputer 30 previously stores a program for producing driving signals of the negative electrode line scan circuit 1 and the positive electrode line drive circuit 2 which will be described below in synchronism with the incoming light emission data.

As shown in FIG. 8, the negative electrode scan circuit 1 is provided with scan switches 11 through in for scanning each negative electrode line B1 through Bn in sequence. One terminal of each scan switch 11 through in is connected to reverse bias voltage sources 41 through 4*n* for providing reverse bias voltages with the other terminals connected to the ground potential (0V), respectively.

The reverse bias voltage sources 41 through 4*n* were intended to apply V1 as the reverse bias voltage, the same voltage as the light emission specifying voltage $V_x$ in the prior art. However, the present embodiment employs V1–V2, which is a voltage lower than that of the prior art, as the reverse bias voltage. V2 will be explained later.

The positive electrode drive circuit 2 is provided with the constant-current sources 21 through 24 as drive sources, the reset voltage sources 51 through 54 for providing reset voltage V2, and the drive switches 31 through 34 for selecting each positive electrode line A1 through A4. Turning on an arbitrary drive switch to the constant-current source side allows for connecting the current sources 21 through 24 to the corresponding positive electrode lines.

Positive electrode lines that are not driven during scan are connected to the reset voltage sources 51 through 54. As mentioned later, the reset voltage sources 51 through 54 are connected with the positive electrode lines A1 through A4 during reset, thereby applying the reset voltage V2 to all light-emitting elements E11 to E4*n* in the forward direction.

The reset voltage V2 is made lower than the light-emitting threshold voltage VTH of light-emitting elements, thereby preventing light-emitting elements from emitting light during reset. As mentioned, the positive electrode line drive circuit 2 is different from the prior art in the points that the positive electrode line drive circuit 2 is provided with the reset voltage sources 51 through 54 for providing the reset voltage V2, and positive electrode lines that are not driven are connected to the reset voltage sources 51 through 54.

The light emission control circuit 3 controls turning on and off of the scan switches 11 through in and the drive switches 31 through 34.

Referring to FIG. 8 through FIG. 11, the light emission operation of the first embodiment will be explained below.

Like the prior art example, the operation to be described below is an example in which negative electrode line B1 is scanned to cause light-emitting elements E11 and E21 to emit light and then light-emitting elements E22 and E32 to emit light by scanning the negative electrode line B2.

First, referring to FIG. 8, the scan switch 11 is switched to the ground and the negative electrode line B1 is scanned. To other negative electrode lines B2 through Bn, the scan switches 12 through 1*n* allow the reverse bias voltage sources 41 through 4*n* to apply V1–V2. Furthermore, the positive electrode lines A1 and A2 are connected with the constant-current sources 21 and 22 by means of the drive switches 31 and 32. In addition, other positive electrode lines A3 and A4 are connected with the reset voltage sources 53 and 54, and the reset voltage V2 is applied thereto.

Therefore, as shown with arrows in FIG. 8, drive current flows only into the light-emitting elements E11 and E21 from the constant-current sources 21 and 22 to cause only the light-emitting elements E11 and E21 to emit light under a steady state of light emission.

As shown in FIG. 8, a voltage of V2 is applied to light-emitting elements E31, E41, E12–E1*n*, and E22–E2*n*. Since V2 is lower than the light-emitting threshold voltage, current scarcely flows through these light-emitting elements and hence, practically no light emission is provided. Moreover, –(V1–2V2) of reverse-directional voltage is applied to the light-emitting elements E32–E3*n* and E42–E4*n*, and these light-emitting elements are not allowed to emit light.

When scanning is shifted from the light-emitting state shown in FIG. 8 to the state, shown in FIG. 11, in which the light-emitting elements E22 and E32 emit light, the reset control is performed as shown in FIG. 9.

That is, before scanning is shifted from the negative electrode line B1 of FIG. 8 to the negative electrode line B2 of FIG. 11, all drive switches 31 through 34 are switched over to the reset voltage sources 51 through 54 and as well all scan switches 11 through 1*n* are switched over to 0V for reset as shown in FIG. 9. When the reset has been performed, a voltage of V2 is applied to all light-emitting elements E11 through E4*n*. Therefore, light-emitting elements with a voltage different from V2 applied thereto are charged or discharged as shown with the arrows in FIG. 9. Consequently, parasitic capacitors of all light-emitting elements E11 through E4*n* are charged so as to make the voltage across both ends V2.

As mentioned in the foregoing, as shown in FIG. 10 after the reset control has been performed, the scan switch 12 corresponding to the negative electrode line B2 is not switched over but made 0V, the scan switches 11, and 13 through 1*n* corresponding to other negative electrode lines B1, and B3 through Bn are switched over to the reverse bias voltage sources 41, and 43 through 4*n* to scan the negative electrode line B2. Simultaneously, the drive switches 32 and 33 are switched over to the constant-current sources 22 and 23, and the drive switches 31 and 34 are switched over to the reset voltage sources 51 and 54.

As mentioned above, at the instant of switching of the scan switches 11 through 1*n* and the drive switches 31 through 34, the potential of the positive electrode lines A2 and A3 becomes approximately V1 (precisely speaking, (n−1/n)_EV1) due to the applied voltage V1–V2 by means of the reverse bias voltage sources 41, and 43 through 4*n* and the voltage across both ends V2 due to a charged charge of the light-emitting elements E21, E23 through E2*n*, E31, and E33 through E3*n*, the voltage across both ends of the light-emitting elements E22 and E32 is a forward-biased voltage approximately equal to the light emission specifying voltage $V_x$. That is, the voltage of the reverse bias voltage sources 41 through 4*n* is set to V1–V2 in response to the reset voltage V2 to be applied to the reset voltage sources 51 through 54, thereby allowing both ends of light-emitting elements E22 and E32 to be roughly equal to the light emission specifying voltage $V_x$. This allows the light-emitting elements E22 and E32 to quickly be charged by current flowing from a plurality of routes shown with arrows in FIG. 10, and thus allowing for shifting instantaneously to a steady state of light emission shown in FIG. 11.

Furthermore, a reverse-directional voltage of –(V1–2V2) is applied to light-emitting elements E11, and E13 through E1*n*, E41, and E43 through E4*n* which are charged as shown with arrows in FIG. 10 in response to the difference between the voltage and voltage V2 at the time of reset, which has been explained referring to FIG. 9.

Furthermore, since the voltage applied to the light-emitting elements E12 and E42 is V2, no current flows therethrough. In addition, even when the light-emitting elements E21, and E23 through E2*n*, E31, and E33 through E3*n* are brought into a steady state of light emission as shown in FIG. 11, the voltage across both ends still remains V2, and hence, no current flows in from the constant-current sources 32 and 33. As mentioned in the foregoing, at a steady state of light emission shown in FIG. 11, the drive current supplied by the constant-current sources 32 and 33 flows into the light-emitting elements E22 and E32, and hence the light-emitting elements E21 and E32 emit light at the desired instantaneous luminance Lx.

Power consumption of the present embodiment will be explained referring to Tables 1 and 2.

Figure 1:
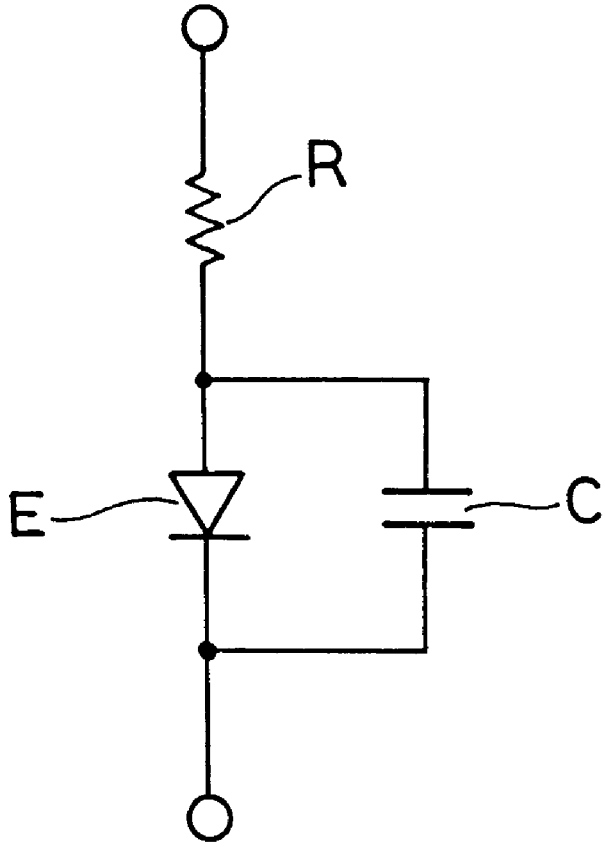
FIG. 1 PRIOR ART
FIG. 1 is a view showing an equivalent circuit of an organic EL element.
Figure 2A:
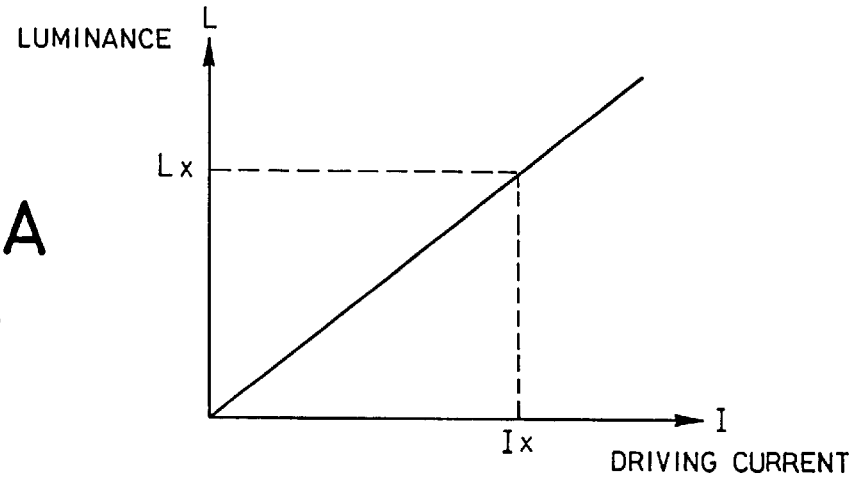
FIG. 2A PRIOR ART
FIGS. 2A through 2C are views for explaining the relationship between the light emission luminance, drive voltage, and drive current of an organic EL element.
Figure 2B:
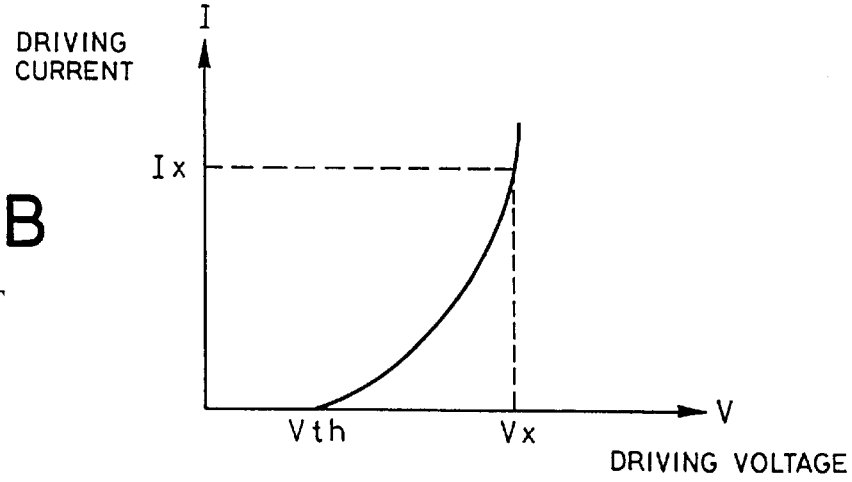
FIG. 2B PRIOR ART
Figure 2C:
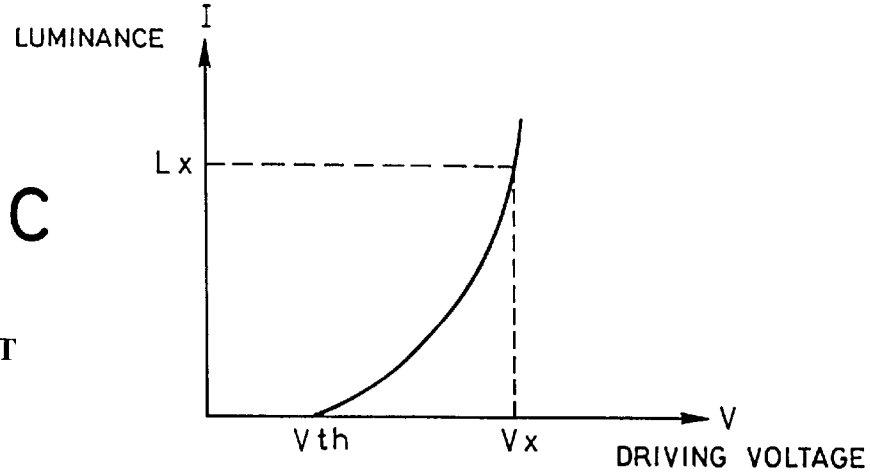
FIG. 2C PRIOR ART
Figure 3:
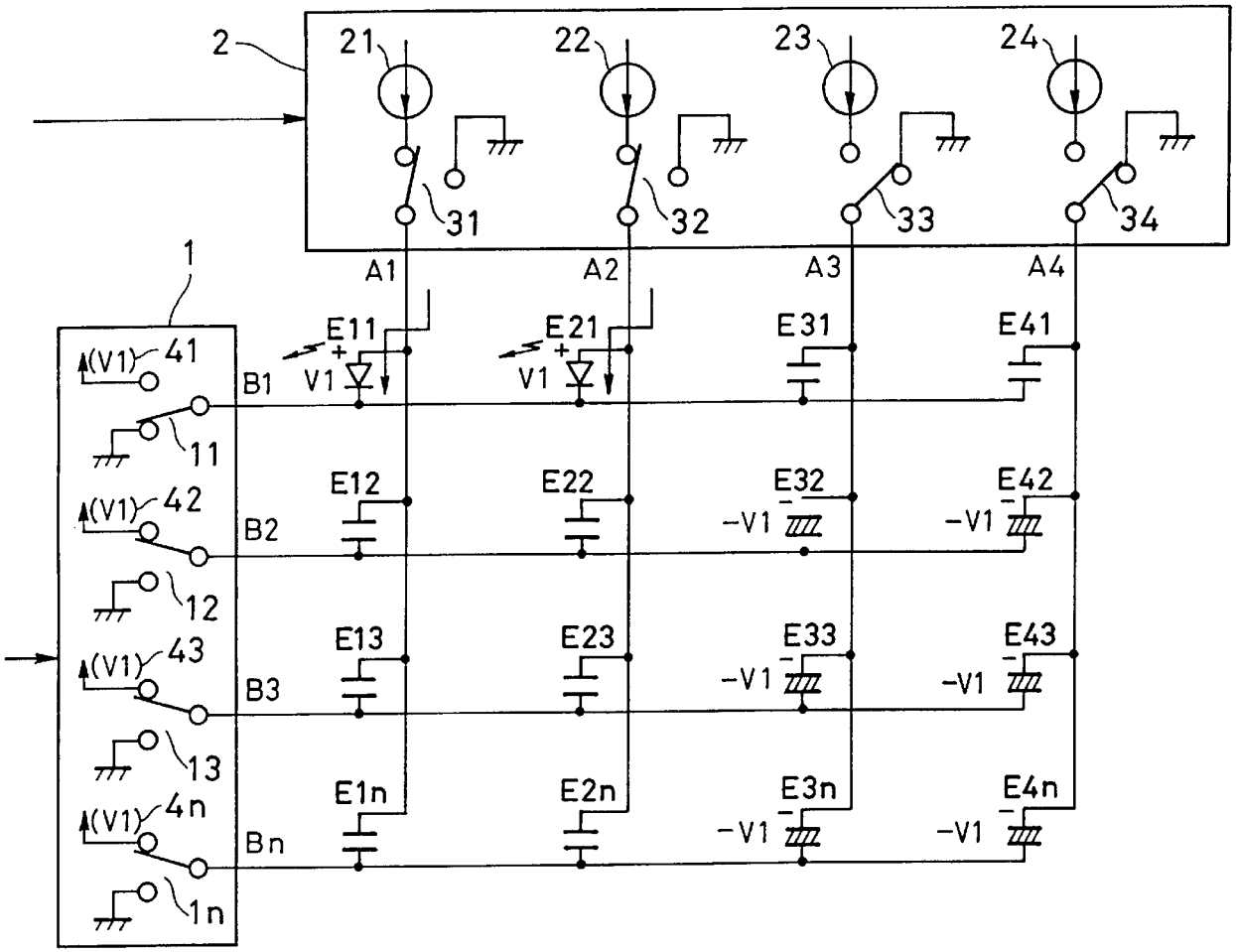
FIG. 3 PRIOR ART
FIG. 3 is a view showing a configuration of the prior art under light emission status A.
Figure 4:
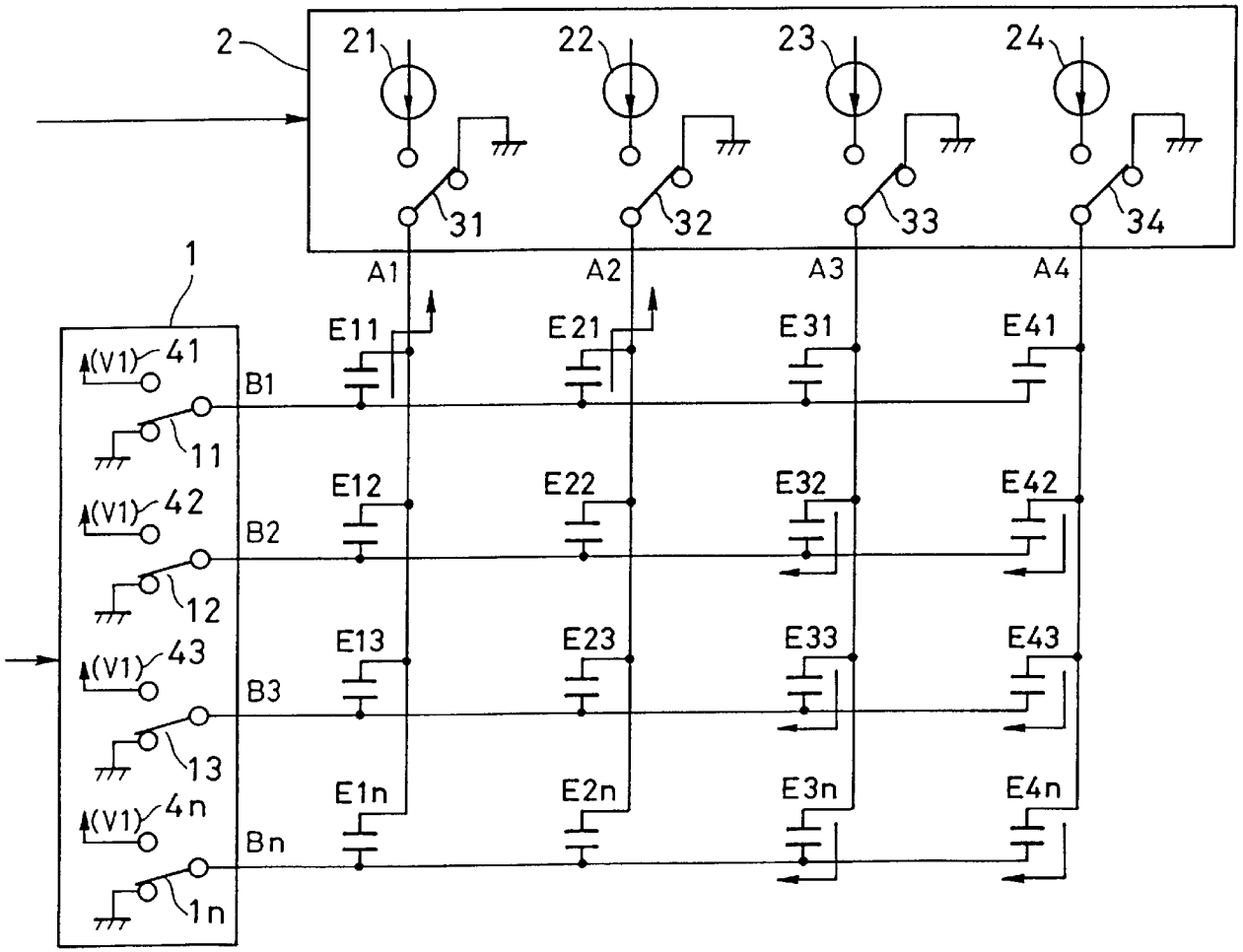
FIG. 4 PRIOR ART
FIG. 4 is a view showing a configuration of the prior art under reset status.
Figure 5:
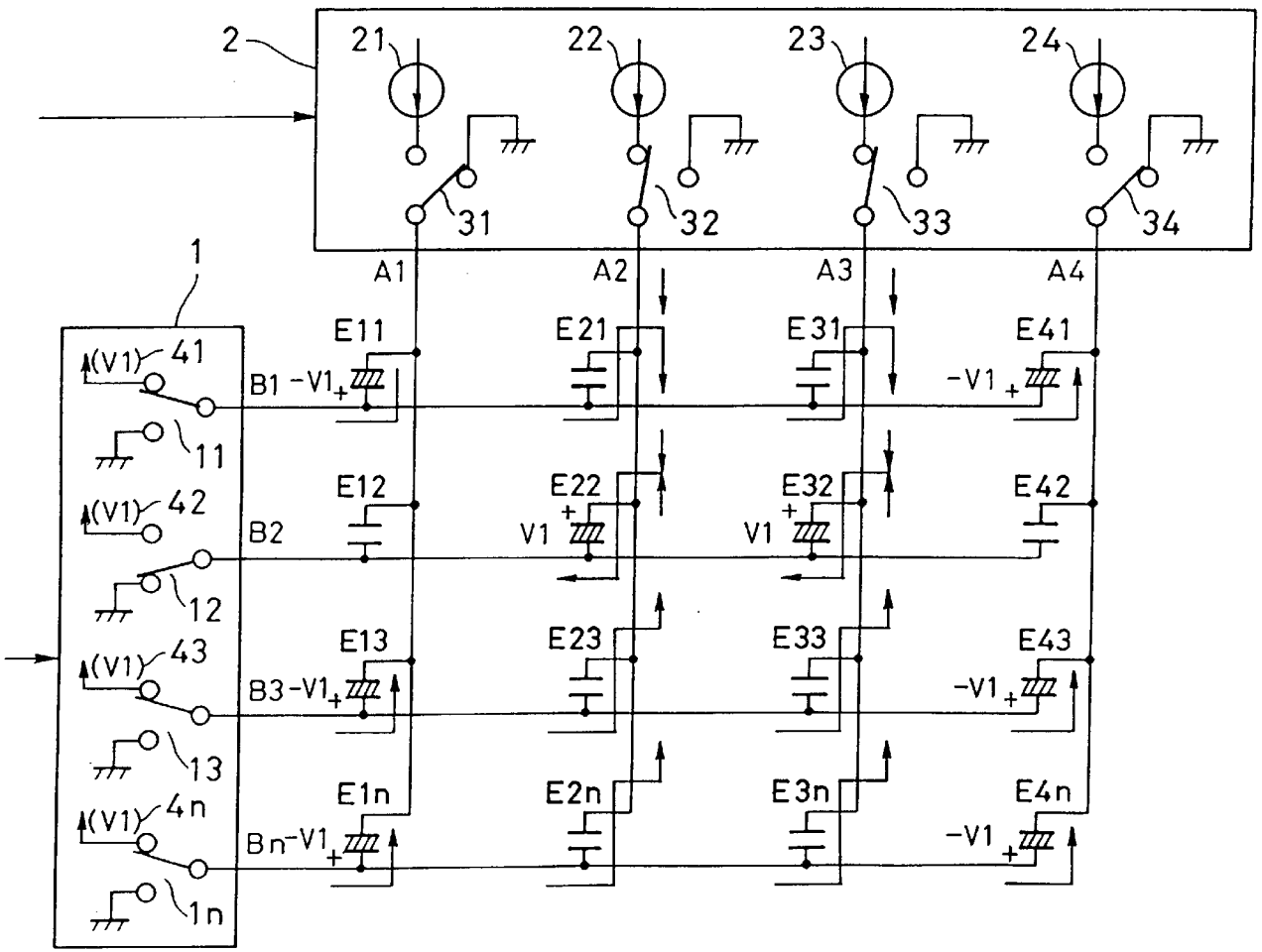
FIG. 5 PRIOR ART
FIG. 5 is a view showing a configuration of the prior art at the time of switchover to light emission status B.
Figure 6:
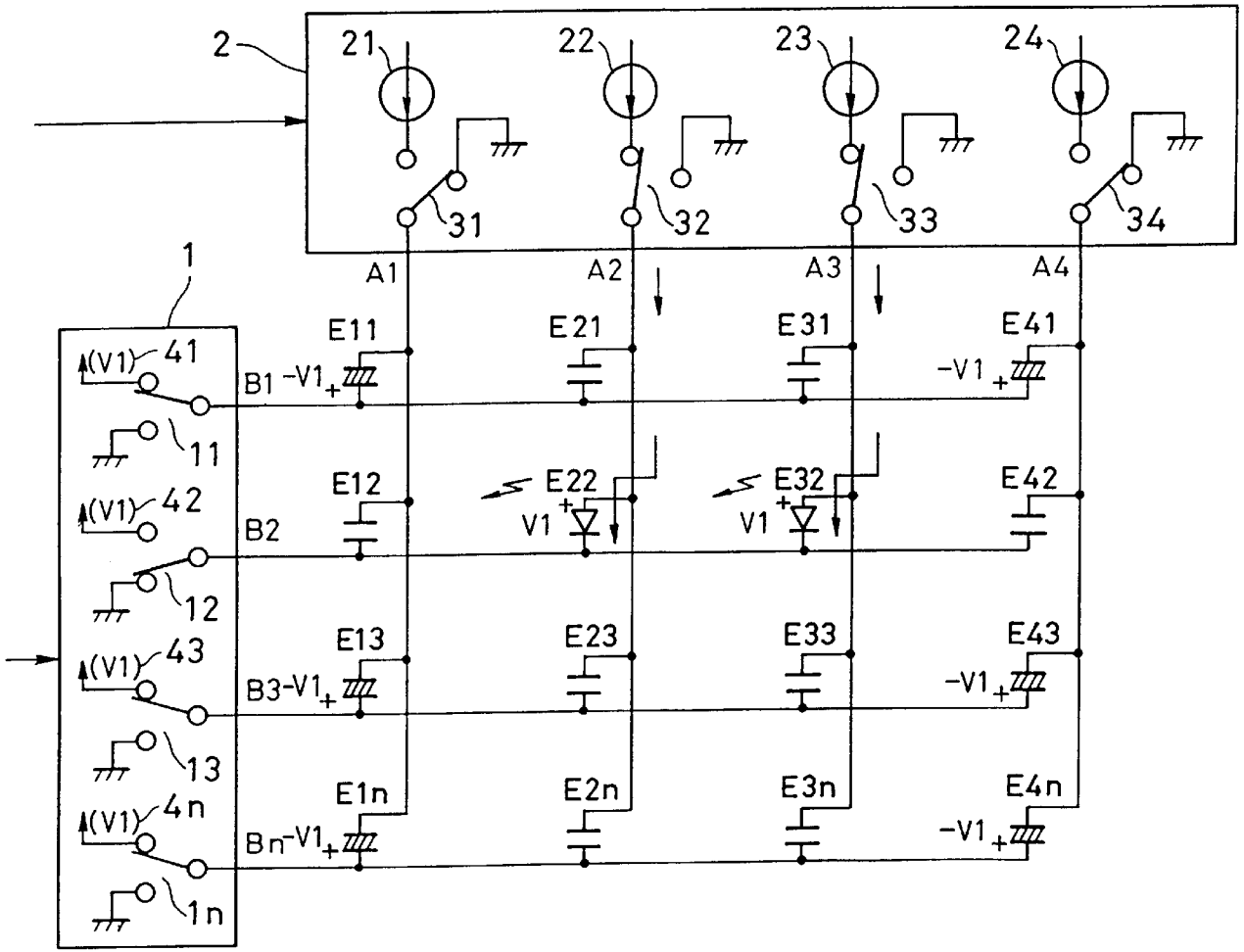
FIG. 6 PRIOR ART
FIG. 6 is a view showing a configuration of a prior art under light emission status B.
Figure 7A:
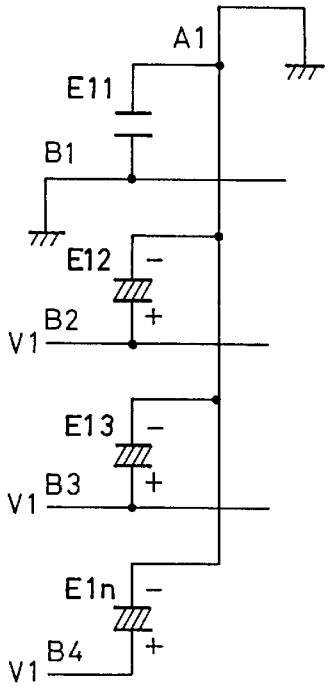
FIG.7A PRIOR ART
FIGS. 7A and 7B are views for explaining the status of charging and discharging according to the prior art.
Figure 7B:
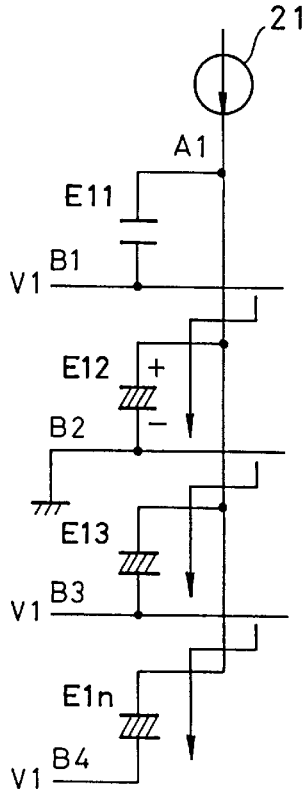
FIG.7B PRIOR ART

Table 1 shows, in comparison to an example of the prior art, the voltages applied to each light-emitting element at steady states of light emission of the light-emitting elements E11 and E21 (FIG. 8 and FIG. 3), and at the reset state (FIG. 9 and FIG. 4). On the other hand, Table 2 shows, in comparison to an example of the prior art, the voltages applied to each light-emitting element at steady states of light emission of the light-emitting elements E22 and E32 (FIG. 10 and FIG. 5), and at the reset state (FIG. 9 and FIG. 4).

TABLE 1

| Light-emitting element | Prior art | | | First embodiment | | |
|---|---|---|---|---|---|---|
| | Voltage | | Difference in voltage | Voltage | | Difference in voltage |
| | Drive | Reset | | Drive | Reset | |
| E11, E21 | V1 | 0 | −V1 | V1 | V2 | −(V1 − V2) |
| E31, E41 | 0 | 0 | 0 | V2 | V2 | 0 |
| E12, E13, E1n, E22, E23, E2n | 0 | 0 | 0 | V2 | V2 | 0 |
| E32, E33, E3n | −V1 | 0 | V1 | −(V1 − 2V2) | V2 | V1 − V2 |

TABLE 2

| Light-emitting element | Prior art Voltage Reset | Prior art Voltage Drive | Prior art Difference in voltage | First embodiment Voltage Reset | First embodiment Voltage Drive | First embodiment Difference in voltage |
|---|---|---|---|---|---|---|
| E22, E32 | 0 | V1 | V1 | V2 | V1 | V1 − V2 |
| E12, E42 | 0 | 0 | 0 | V2 | V2 | 0 |
| E11, E13, E1n, E41, E43, E2n | 0 | −V1 | −V1 | V2 | −(V1 − 2V2) | −(V1 − V2) |
| E21, E23, E2n, E31, E33, E3n | 0 | 0 | 0 | V2 | V2 | 0 |

At the time of switching, a potential corresponding to the difference in voltage of Tables 1 and 2 is produced across both ends of light-emitting elements to charge and discharge the parasitic capacitors.

As shown in Tables 1 and 2, the difference in voltage was V1 in the example of the prior art, whereas the difference in voltage is V1–V2 according to the first embodiment, and thus the difference in voltage is made lower. Moreover, a voltage of –V1 according to the example of the prior art has been also reduced to a lower difference in voltage of –(V1–V2) according to the first embodiment.

Since the charge to be charged or discharged to and from the parasitic capacitance of light-emitting elements is proportional to the difference in voltage, the drive power for the first embodiment can be considerably reduced compared with the example of the prior art.

Figure 12:
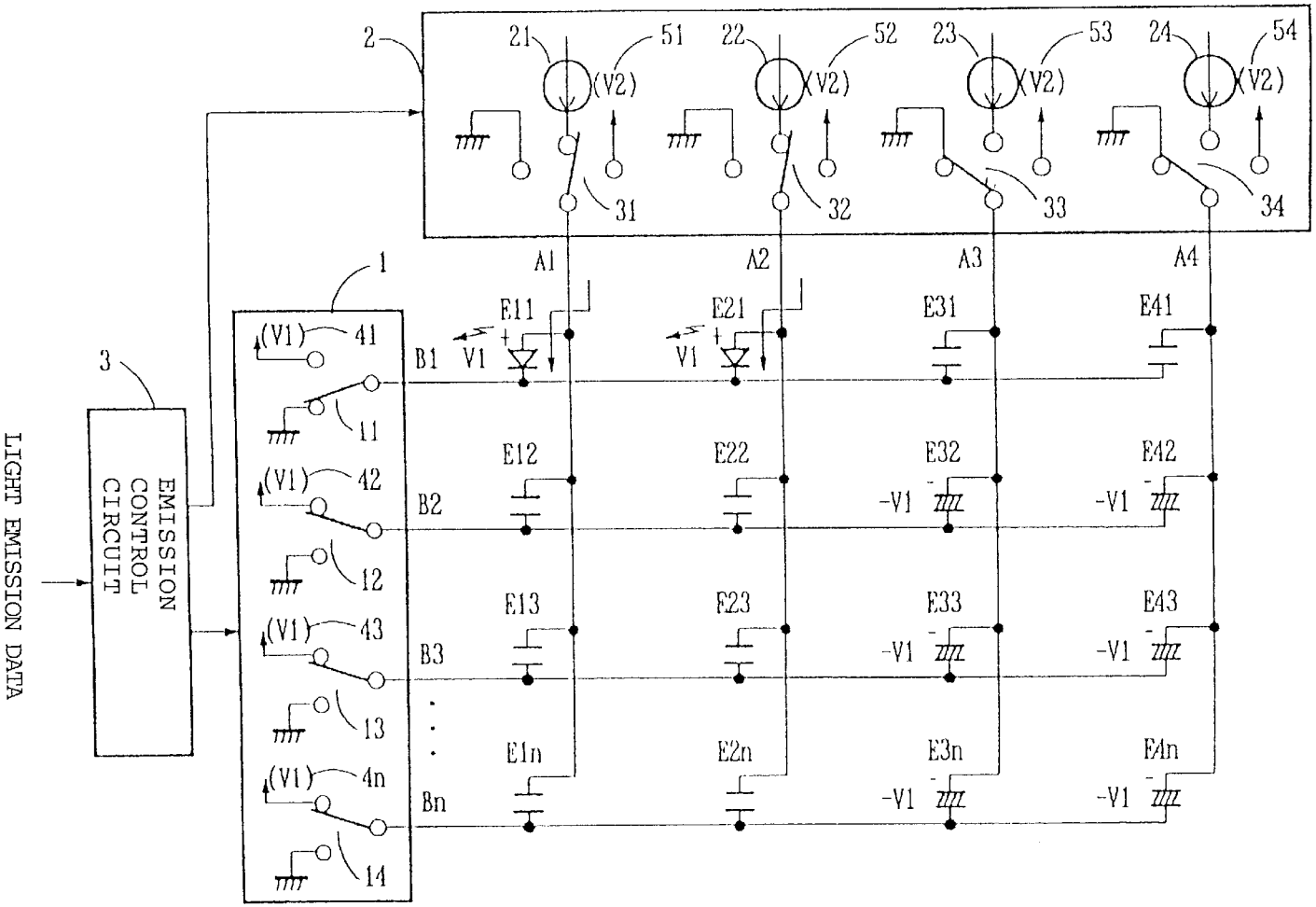
FIG. 12 is a view showing a configuration of the second embodiment of the present invention under light emission status A.
Figure 13:
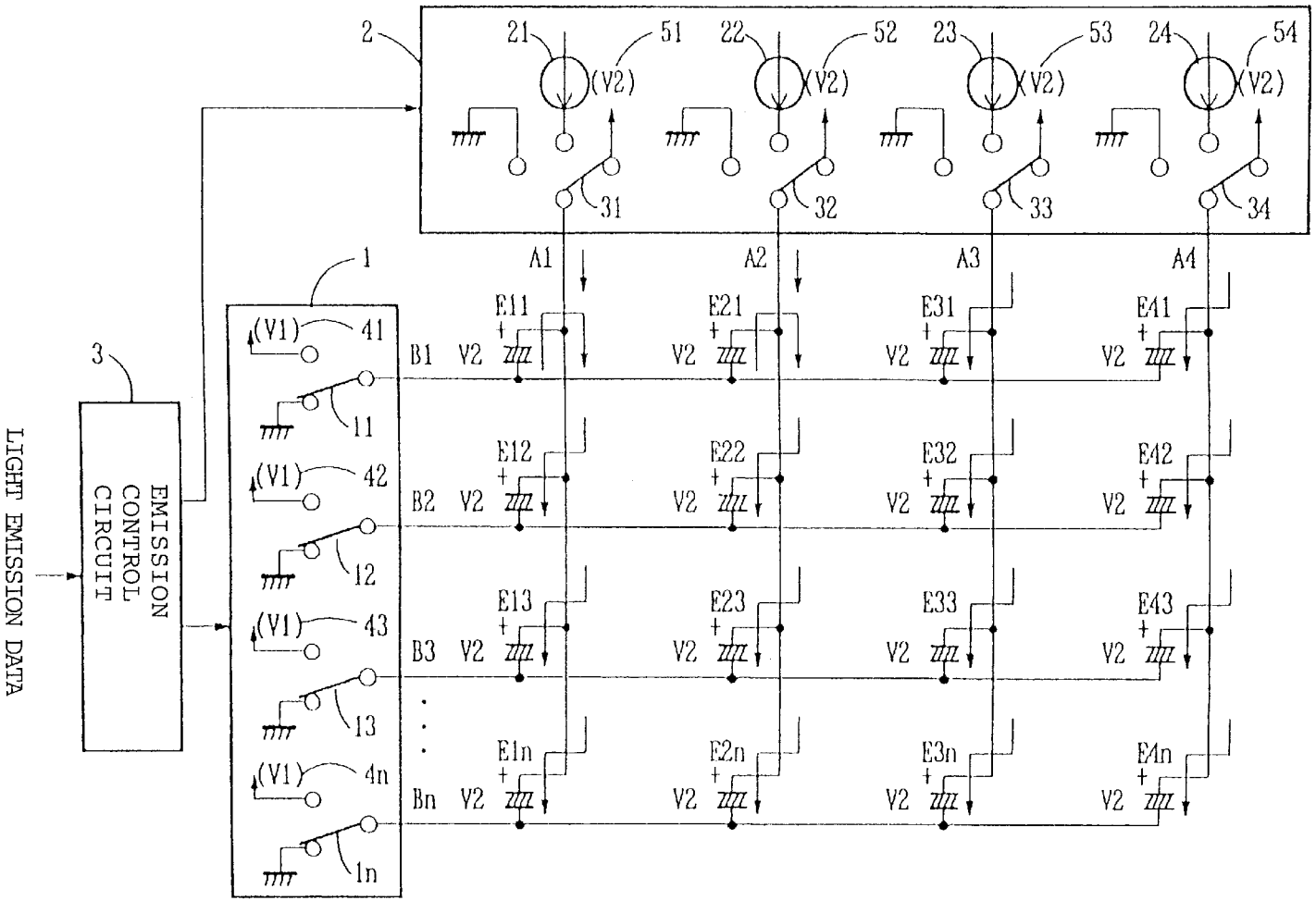
FIG. 13 is a view showing a configuration of the second embodiment of the present invention under reset status, FIG. 14 a view showing a configuration of the second embodiment of the present invention at the time of switchover to light emission status B.
Figure 14:
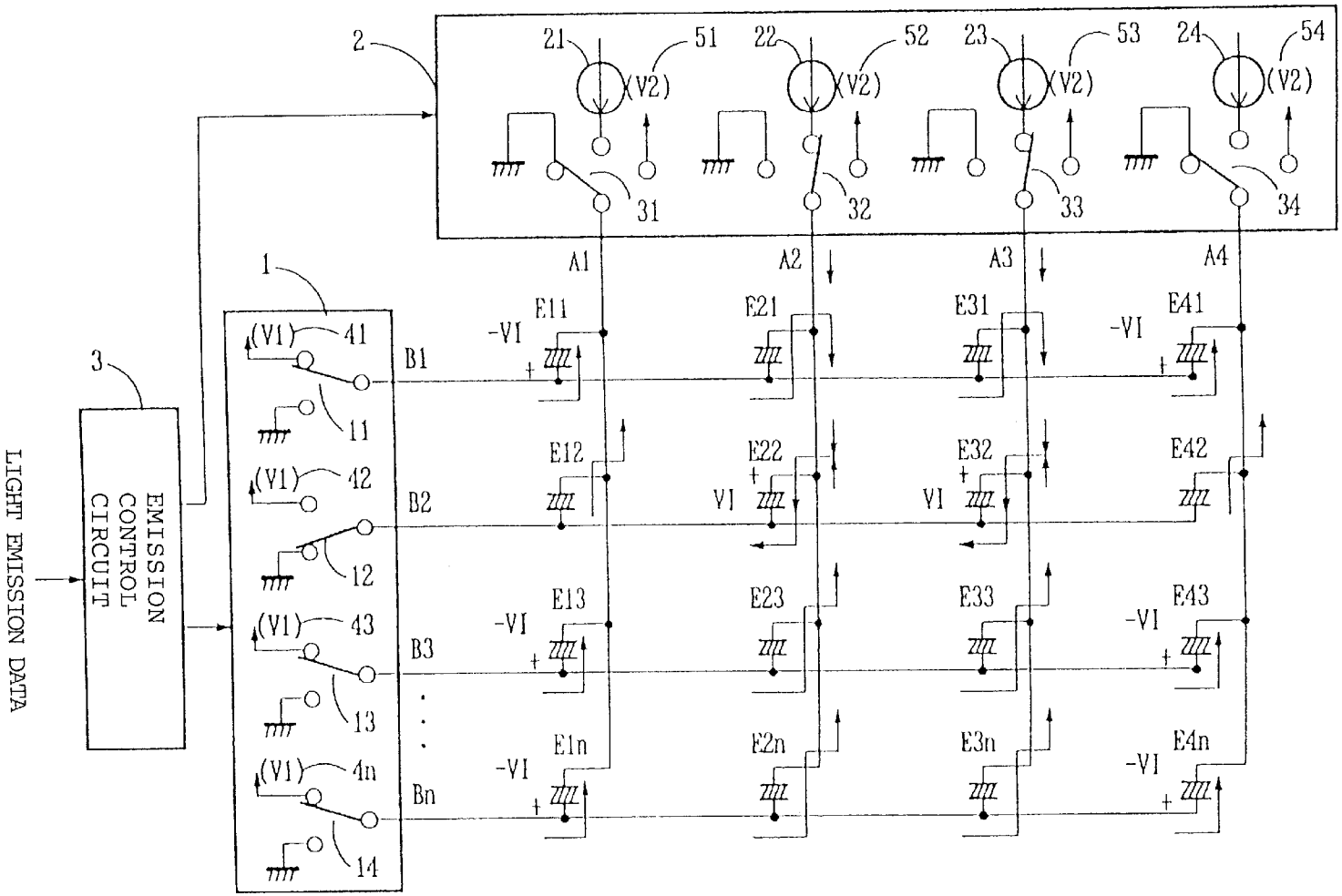
Figure 15:
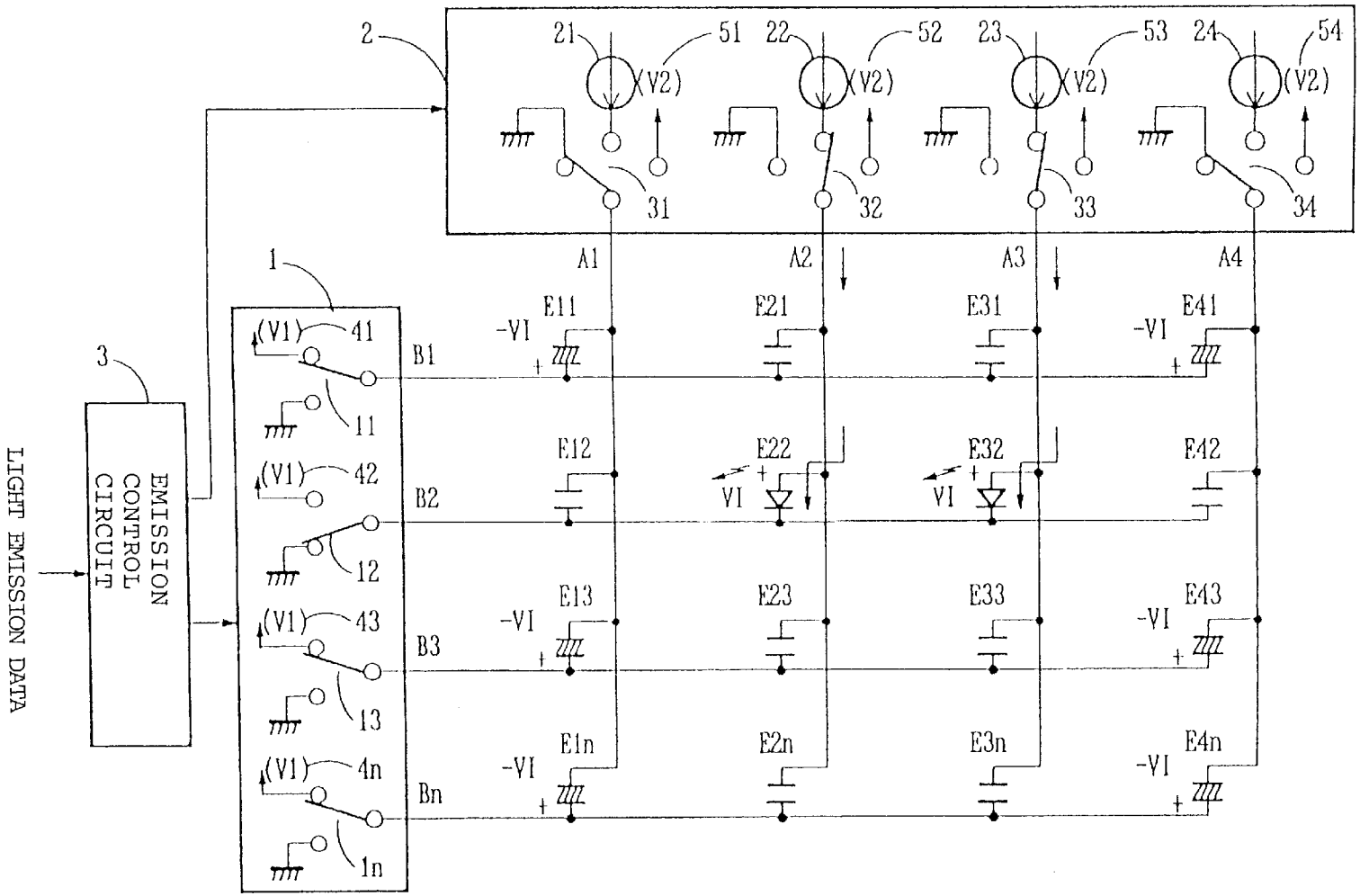
FIG. 15 is a view showing a configuration of the second embodiment of the present invention under light emission status B.

Referring to FIG. 12 through FIG. 15, a second embodiment of the present invention will be explained. FIG. 12 through FIG. 15 are views showing the configuration of the second embodiment of the present invention. FIG. 12 shows the light emission status A, FIG. 13 shows the reset status, FIG. 14 shows the time of switchover to the light emission status B, and FIG. 15 shows the light emission status B.

What is different between the second and the first embodiments is as follows. In the first embodiment, the scan switches 11 through 1*n* are constructed so as to perform switching between the ground voltage and the reverse bias voltage sources 41 through 4*n* having a voltage of V1–V2. On the other hand, in the second embodiment, switching is performed between the ground voltage and the reverse bias voltage sources 41 through 4*n* having a voltage of V1.

Furthermore, in the first embodiment the drive switches 31 through 34 are intended so as to perform switching between the constant-current sources 21 through 24 and the reset voltage source V2, whereas in the second embodiment the drive switches 31 through 34 are intended to perform switching between any of the constant-current sources 21 through 24, reset voltage sources 51 through 54 having a voltage of V2, and the ground voltage.

Referring to FIG. 12 through FIG. 15, the operation of light emission of the second embodiment will be explained below.

Like the first embodiment, an example will be explained in which, after the negative electrode line B1 is scanned to cause the light-emitting elements E11 and E21 to emit light, the scan is shifted to the negative electrode line B2 to cause the light-emitting elements E22 and E32 to emit light.

First in FIG. 12, the scan switch 11 is switched over to the 0V side and then the negative electrode line B1 is scanned. To other negative electrode lines B2 through Bn, the reverse bias voltage source V1 is applied by the reverse bias voltage sources 42 through 4*n*. Furthermore, to the positive electrode lines A1 and A2, the drive switches 31 and 32 connect the constant-current sources 21 and 22. To other positive electrode lines A3 through A4 are supplied with a voltage of 0V.

Therefore, in the case of FIG. 12, only the light-emitting elements E11 and E21 allow drive current to flow therein as shown with the arrows from the constant-current sources 21 and 22, and thus only the light-emitting elements E11 and E21 are emitting light at a steady state of light emission. On the other hand, other light-emitting elements are at the same charged status as the prior art.

At the time scan is shifted from the light-emitting state shown in FIG. 12 to the light-emitting state of the light-emitting elements E22 and E32 shown in FIG. 15, the reset control shown in FIG. 13 is performed.

That is, before scan is shifted from the negative electrode line B1 shown in FIG. 12 to the negative electrode line B2 shown in FIG. 15, first as shown in FIG. 13, all drive switches 31 through 34 are switched over to the side of reset voltage sources 51 through 54, and, as well, all scan switches 11 through 14 are switched over to the side of 0V to perform reset. Consequently, electric charge is charged into the parasitic capacitors of all light-emitting elements E11 through E4*n* to raise the voltages across both ends thereof to V2.

As mentioned above, after the reset control has been performed, as shown in FIG. 14, the scan switches 12 corresponding to the negative electrode line B2 are not switched over but remain at the side of 0V. The scan switches 11 and 13 through in corresponding to other negative electrode lines B1 and B3 through Bn are switched over to the side of the reverse bias voltage sources 41 and 43 through 4*n* to scan the negative electrode line B2. Simultaneously, the drive switches 32 and 33 are switched over to the constant-current sources 22 and 23 and, as well, the drive switches 31 through 34 are switched over to the ground side.

At the instant the switches 11 through 1*n* and 31 through 34 have been switched over as mentioned above, the potentials of the positive electrode lines A2 and A3 become approximately V1+V2 due to a voltage V1 of the reverse bias voltage sources 41 and 43 through 4*n*, and a voltage of V2 caused by the charged charge of the light-emitting elements E21, E23 through E2*n*, E31, and E33 through E3*n* across both ends thereof. The voltage across both ends of the light-emitting elements E22 and E32 is a forward bias voltage of approximately V1+V2, which is greater than the light emission specifying voltage $V_x$.

This allows the light-emitting elements E22 and E32 to be quickly charged by the currents from a plurality of routes shown with arrows in FIG. 14 to emit light with instantaneous luminance greater than the instantaneous luminance $L_x$ under a steady state of light emission and then to be shifted to a steady state of light emission shown in FIG. 15.

Figure 16:
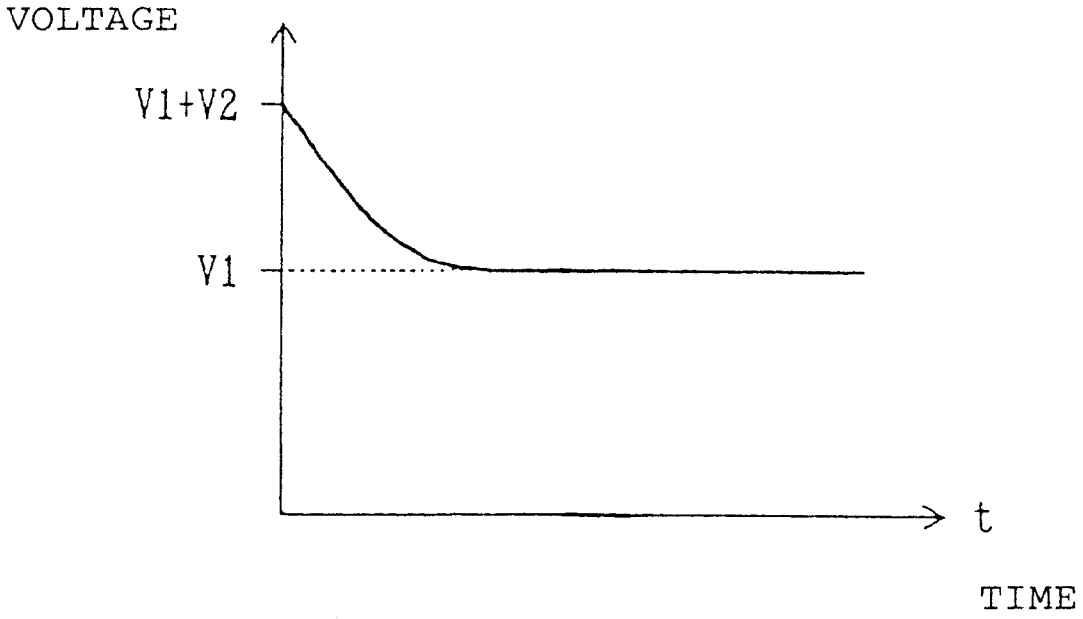
FIG. 16 is a view for explaining the operation of a light-emitting element of the second embodiment.

FIG. 16 shows the transition state of the voltage across both ends of the light-emitting elements E22 and E32 until the light-emitting elements E22 and E32 shown in FIG. 14 are shifted to a steady state of light emission. As shown in the figure, the voltage across both ends of the light-emitting elements E22 and E32 becomes approximately V1+V2 immediately after the scanning of negative electrode line B2 has been initiated and soon converges to the light emission specifying voltage V1 (=$V_x$) to fall in a steady state of light emission.

As mentioned above, the light-emitting elements E22 and E32 emit light with instantaneous luminance greater than the instantaneous luminance $L_x$ under a steady state of light emission only immediately after the scanning of negative electrode line B2 has been initiated. The excessive luminance supplements the non-light-emission period resulting from the reset immediately before, thus allowing for displaying images without reducing the luminance.

Explanation has been made for the embodiments of the present invention in the foregoing, however, the present invention is not limited to a light-emitting display device that employs organic EL elements, but is also applicable to elements if the element has the properties of capacitance and the diode like organic EL elements.

As explained above, during the period of reset, the present invention allows all scan lines to be given a first reset voltage and, as well, all drive lines to be given a second reset voltage that is greater than the first reset voltage. For this reason, a light-emitting display device can be provided which allows for realizing high performance such as a reduction in power consumption while a rise in light emission made quick at the time of switching of the scanning like in the prior art reset drive method.

What is claimed is:

1. A light-emitting display device in which light-emitting elements are connected to intersections of positive electrode lines and negative electrode lines arranged in a matrix, either one of the positive electrode lines or the negative electrode lines are employed as scan lines with the other employed as drive lines; a scan period during which, while scanning the scan lines, drive sources are connected to desired drive lines in synchronization with the scanning of the scan lines, thus the light-emitting elements connected to the intersections of the scan lines and drive lines are lit, and a reset period for providing a reset voltage to light-emitting elements are alternately repeated for display by light emission, said light-emitting display device comprising:

scan switch means for enabling either of grounding means for providing a ground potential or a reverse bias voltage source for providing a predetermined reverse bias voltage to connect to each of said scan lines;

drive switch means for enabling either of said drive source to said each drive lines or reset voltage sources for providing said reset voltage to connect to each of said drive lines; and control means for controlling the switching of said scan switch means and said drive switch means to apply a reset voltage to all of said light-emitting elements in a forward direction during said reset period, wherein said reverse bias voltage source has substantially the same voltage as the voltage determined by subtracting said reset voltage from the light emission specifying voltage of light-emitting elements.

2. The light-emitting display device according to claim 1, wherein said reset voltage is set to be lower than a light emission threshold voltage of said light-emitting elements.

3. The light-emitting display device according to claim 1, wherein said drive switch means allow for selectively connecting to either one of said drive sources, said reset voltage sources, or grounding means for providing the ground potential.

4. The light-emitting display device according to claim 2, wherein said drive switch means allow for selectively connecting to either one of said drive sources, said reset voltage sources, or grounding means for providing the ground potential.

5. A light-emitting display device in which light-emitting elements are connected to intersections of positive electrode lines and negative electrode lines arranged in a matrix, either one of the positive electrode lines or the negative electrode lines are employed as scan lines with the other employed as drive lines; a scan period during which, while scanning the scan lines, drive sources are connected to desired drive lines in synchronization with the scanning of the scan lines, thus the light-emitting elements connected to the intersections of the scan lines and drive lines are lit, and a reset period for providing a reset voltage to light-emitting elements are alternately repeated for display by light emission, said light-emitting display device comprising:

scan switch means for enabling either of grounding means for providing a ground potential or a reverse bias voltage source for providing a predetermined reverse bias voltage to connect to each of said scan lines;

drive switch means for enabling either of said drive source to said each drive lines or reset voltage sources for providing said reset voltage to connect to each of said drive lines; and control means for controlling the switching of said scan switch means and said drive switch means to apply a reset voltage to all of said light-emitting elements in a forward direction during said reset period, wherein the voltage of said reverse bias voltage source is set to be substantially the same as a light emission specifying voltage of said light-emitting elements.

6. The light-emitting display device according to claim 3, wherein, during said reset period, all of said scan switch means are connected to said grounding means and said drive switch means are connected to said reset voltage sources.

7. The light-emitting display device according to claim 4, wherein, during said reset period, all of said scan switch means are connected to said grounding means and all of said drive switch means are connected to said reset voltage sources.

8. The light-emitting display device according to claim 5, wherein, during said reset period, all of said scan switch means are connected to said grounding means and all of said drive switch means are connected to said reset voltage sources.

9. The light-emitting display device according to claim 3, wherein, during said scan period, said scan switch means to be scanned are connected to said grounding means, said scan switch means not to be scanned are connected to said reverse bias voltage sources, said drive switch means to be driven are connected to said drive sources, and said drive switch means not to be driven are connected to said grounding means.

10. The light-emitting display device according to claim 4, wherein, during said scan period, said scan switch means to be scanned are connected to said grounding means, said scan switch means not to be scanned are connected to said reverse bias voltage sources, said drive switch means to be driven are connected to said drive sources, and said drive switch means not to be driven are connected to said grounding means.

11. The light-emitting display device according to claim 5, wherein, during said scan period, said scan switch means to be scanned are connected to said grounding means, said scan switch means not to be scanned are connected to said reverse bias voltage sources, said drive switch means to be driven are connected to said drive sources, and said drive switch means not to be driven are connected to said grounding means.

12. The light-emitting display device according to claim 6, wherein, during said scan period, said scan switch means to be scanned are connected to said grounding means, said scan switch means not to be scanned are connected to said reverse bias voltage sources, said drive switch means to be driven are connected to said drive sources, and said drive switch means not to be driven are connected to said grounding means.

13. The light-emitting display device according to claim 7, wherein, during said scan period, said scan switch means to be scanned are connected to said grounding means, said scan switch means not to be scanned are connected to said reverse bias voltage sources, said drive switch means to be driven are connected to said drive sources, and said drive switch means not to be driven are connected to said grounding means.

14. The light-emitting display device according to claim 8, wherein, during said scan period, said scan switch means to be hscanned are connected to said grounding means, said scan switch means not to be scanned are connected to said reverse bias voltage sources, said drive switch means to be driven are connected to said drive sources, and said drive switch means not to be driven are connected to said grounding means.

15. The light emitting display device according to claim 1, wherein, during said scan period, said scan switch means provides said ground potential to one of said scan lines to be scanned and provides said reverse bias voltage to said scan lines not to be scanned during said scan period, and wherein, during said scan period, said drive switch means connects said drive lines to be driven to said drive sources and connects said drive lines not to be driven to said reset voltage.

16. The light emitting display device according to claim 2, wherein, during said scan period, said scan switch means provides said ground potential to one of said scan lines to be scanned and provides said reverse bias voltage to said scan lines not to be scanned during said scan period, and wherein, during said scan period, said drive switch means connects said drive lines to be driven to said drive sources and connects said drive lines not to be driven to said reset voltage.

17. A display apparatus, comprising:

a plurality of light-emitting devices respectively connected between a plurality of scan lines and a plurality of drive lines;

a scan circuit which selectively connects said scan lines to a first voltage and a second voltage, wherein a value of said first voltage is different than a value of said second voltage;

a driving circuit which selectively connects said drive lines to a third voltage and a drive source, wherein a value of said third voltage is different than each of said values of said first voltage and said second voltage; and control means for controlling said scan circuit and said driving circuit to apply a reset voltage to all of said light-emitting devices in a forward direction during a reset period, wherein, during a scan period, a particular light-emitting device is illuminated by connecting a particular scan line connected to said particular light-emitting device to said second voltage and by connecting a particular drive line connected to said particular light-emitting device to said drive source, and wherein said value of said first voltage substantially equals a difference between said value of said third voltage and a light emission specifying voltage value of said light-emitting devices.

18. The display device according to claim 17, wherein said value of said third voltage is greater than said value of second voltage.

19. The display device according to claim 17, wherein said second voltage has a ground potential.

20. The display device according to claim 18, wherein said value of said first voltage is greater than said value of said third voltage.

21. The display device according to claim 18, wherein said value of said first voltage is greater than said value of said second voltage.

22. The display device according to claim 20, wherein said value of said first voltage is greater than said value of said second voltage.

23. The display device according to claim 17, wherein said value of said third voltage is lower than a light emission threshold voltage value of said light-emitting devices.

24. A display apparatus, comprising:

a plurality of light-emitting devices respectively connected between a plurality of scan lines and a plurality of drive lines;

a scan circuit which selectively connects said scan lines to a first voltage and a second voltage, wherein a value of said first voltage is different than a value of said second voltage;

a driving circuit which selectively connects said drive lines to a third voltage and a drive source, wherein a value of said third voltage is different than each of said values of said first voltage and said second voltage; and control means for controlling said scan circuit and said driving circuit to apply a reset voltage to all of said light-emitting devices in a forward direction during a reset period, wherein, during a scan period, a particular light-emitting device is illuminated by connecting a particular scan line connected to said particular light-emitting device to said second voltage and by connecting a particular drive line connected to said particular light-emitting device to said drive source, wherein said value of said first voltage substantially equals a light emission threshold voltage value of said light-emitting devices.

25. The display device according to claim 17, wherein, during said reset period, said scan circuit connects said scan lines to said second voltage, and wherein, during said reset period, said driving circuit connects said drive lines to said third voltage.

26. The display device according to claim 17, wherein, during said scan period, scan lines which are not connected to light-emitting devices to be illuminated are connected to said first voltage and drive lines which are not connected to said light-emitting devices to be illuminated are connected to said third voltage.

27. The display device according to claim 17, wherein said driving circuit selectively connects said drive lines to said third voltage, said drive source, and a fourth voltage, wherein a value of said fourth voltage is different than each of said values of said first voltage and said third voltage.

28. The display device according to claim 27, wherein said value of said fourth voltage substantially equals said value of said second voltage.

29. The display device according to claim 28, wherein said value of said fourth voltage and said value of said second voltage substantially equals a ground potential.

30. The display device according to claim 28, wherein, during said reset period, said scan circuit connects said scan lines to said second voltage, and wherein during said reset period said drive circuit connects said drive lines to said third voltage.

31. The display device according to claim 28, wherein, during said scan period, scan lines which are not connected to light-emitting devices to be illuminated are connected to said first voltage and drive lines which are not connected to said light-emitting devices to be illuminated are connected to said fourth voltage.

32. A display apparatus, comprising:

a plurality of light-emitting devices respectively connected between a plurality of scan lines and a plurality of drive lines;

a scan circuit which selectively connects said scan lines to a reverse bias voltage and a ground potential, wherein a value of said reverse bias voltage is different than a value of said ground potential;

a driving circuit which selectively connects said drive lines to a reset voltage and a drive source, wherein a value of said reset voltage is different than each of said values of said reverse bias voltage and said ground potential; and control means for controlling said scan circuit and said driving circuit to apply a reset voltage to all of said light-emitting devices in a forward direction during a reset period, wherein, during a scan period, a particular light-emitting device is illuminated by connecting a particular scan line connected to said particular light-emitting device to said ground potential and by connecting a particular drive line connected to said particular light-emitting device to said drive source, and wherein said value of said reverse bias voltage substantially equals a difference between said value of said reset voltage and a light emission specifying voltage value of said light-emitting devices.

33. The display device according to claim 32, wherein said value of said reset voltage is greater than said value of ground potential, wherein said value of said reverse bias voltage is greater than said value of said reset voltage.

34. The display device according to claim 33, wherein said value of said reset voltage is lower than a light emission threshold voltage value of said light-emitting devices.

35. The display device according to claim 32, wherein, during said reset period, said scan circuit connects said scan lines to said ground potential, and wherein, during said reset period, said driving circuit connects said drive lines to said reset voltage.

36. The display device according to claim 35, wherein, during said scan period, scan lines which are not connected to light-emitting devices to be illuminated are connected to said reverse bias voltage and drive lines which are not connected to said light-emitting devices to be illuminated are connected to said reset voltage.

37. A display apparatus, comprising:

a plurality of light-emitting devices respectively connected between a plurality of scan lines and a plurality of drive lines;

a scan circuit which selectively connects said scan lines to a reverse bias voltage and a ground potential, wherein a value of said reverse bias voltage is different than a value of said ground potential;

a driving circuit which selectively connects said drive lines to a reset voltage and a drive source, wherein a value of said reset voltage is different than each of said values of said reverse bias voltage and said ground potential; and control means for controlling said scan circuit and said driving circuit to apply a reset voltage to all of said light-emitting devices in a forward direction during a reset period, wherein, during a scan period, a particular light-emitting device is illuminated by connecting a particular scan line connected to said particular light-emitting device to said ground potential and by connecting a particular drive line connected to said particular light-emitting device to said drive source, wherein said value of said reverse bias voltage substantially equals a light emission specifying voltage value of said light-emitting devices.

38. The display device according to claim 37, wherein said driving circuit selectively connects said drive lines to said reset voltage, said drive source, and said ground potential.

39. The display device according to claim 38, wherein, during said reset period, said scan circuit connects said scan lines to said ground potential, and wherein, during said reset period, said drive circuit connects said drive lines to said reset voltage.

40. The display device according to claim 39, wherein, during said scan period, scan lines which are not connected to light-emitting devices to be illuminated are connected to said reverse bias voltage and drive lines which are not connected to said light-emitting devices to be illuminated are connected to said ground potential.

* * * * *